US010137703B2

(12) United States Patent
Tsuchiya

(10) Patent No.: US 10,137,703 B2
(45) Date of Patent: Nov. 27, 2018

(54) INKJET PRINTING APPARATUS

(71) Applicant: MIMAKI ENGINEERING CO., LTD., Nagano (JP)

(72) Inventor: Atsushi Tsuchiya, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/123,642

(22) PCT Filed: Mar. 3, 2015

(86) PCT No.: PCT/JP2015/056242
§ 371 (c)(1),
(2) Date: Sep. 4, 2016

(87) PCT Pub. No.: WO2015/133489
PCT Pub. Date: Sep. 11, 2015

(65) Prior Publication Data

US 2017/0072705 A1 Mar. 16, 2017

(30) Foreign Application Priority Data

Mar. 5, 2014 (JP) ..... 2014-043299

(51) Int. Cl.
*B41J 11/00* (2006.01)
*B41J 2/01* (2006.01)

(52) U.S. Cl.
CPC ..... *B41J 11/002* (2013.01); *B41J 2/01* (2013.01)

(58) Field of Classification Search
CPC ..... B41J 11/002; B41J 2/01
See application file for complete search history.

(56) References Cited

U.S. PATENT DOCUMENTS 8,215,761 B2 * 7/2012 Takezawa ..... B41J 11/002 347/101
2012/0256997 A1 * 10/2012 Usuda ..... B41J 2/45 347/233
2013/0271541 A1 * 10/2013 Ohkawa ..... B41J 11/002 347/102

FOREIGN PATENT DOCUMENTS

EP 2692529 2/2014
JP 2009-126071 6/2009
JP 2010-162754 7/2010
(Continued)

OTHER PUBLICATIONS

"International Search Report (Form PCT/ISA/210)", dated Apr. 7, 2015, with English translation thereof, pp. 1-4.
(Continued)

*Primary Examiner* — Henok Legesse
(74) *Attorney, Agent, or Firm* — JCIPRNET

(57) ABSTRACT

There is provided an inkjet printing apparatus that performs printing operation on a recording medium with a satisfactory image quality. An inkjet printing apparatus includes a head that reciprocates in a main scanning direction while discharging an ink onto the medium; and a left irradiator and a right irradiator having a plurality of irradiation elements that are configured to irradiate the ink with light and are mounted on one substrate, the plurality of irradiation elements being arranged in a sub scanning direction, and an array pitch of the plurality of irradiation elements is n/m (m≥1), where a maximum pass width in the plurality of passes is n.

7 Claims, 4 Drawing Sheets

(56) References Cited

FOREIGN PATENT DOCUMENTS

| | | |
|---|---|---|
| JP | 2012-218329 | 11/2012 |
| WO | 2012053647 | 4/2012 |

OTHER PUBLICATIONS

"Office Action of Japan Counterpart Application," with English translation thereof, dated Jun. 20, 2017, p. 1-p. 9.
"Search Report of European Counterpart Application," dated Apr. 18, 2017, p. 1-p. 7.

* cited by examiner

INKJET PRINTING APPARATUS

CROSS-REFERENCE TO RELATED APPLICATION

This application is a 371 of international application of PCT application serial no. PCT/JP2015/056242, filed on Mar. 3, 2015, which claims the priority benefit of Japan application no. JP 2014-043299, filed on Mar. 5, 2014. The entirety of each of the above-mentioned patent applications is hereby incorporated by reference herein and made a part of this specification.

TECHNICAL FIELD

The present disclosure relates to an inkjet printing apparatus.

BACKGROUND ART

Conventionally, inkjet printing apparatuses perform a printing operation by prompting an inkjet head to discharge inks on a recording medium while reciprocating the inkjet head. Some of the inkjet printing apparatuses use inks of ultraviolet curing type as printing inks (hereinbelow referred to as UV ink) (for example, see Patent Literature 1). The UV inks are curable by being irradiated with ultraviolet light.

The inkjet printing apparatus described in Patent Literature 1 is provided with a right ultraviolet irradiation device arranged on a right side of an inkjet head, and a left ultraviolet irradiation device arranged on a left side of the inkjet head. Due to this, ink can be discharged in an outward motion and be irradiated with ultraviolet light, and the ink can also be discharged in an inward motion and be irradiated with the ultraviolet light when moving the inkjet head in reciprocating motions.

CITATION LIST

Patent Literature 1: Japanese Unexamined Patent Publication No. 2010-162754 (published on Jul. 29, 2010)

SUMMARY

Technical Problems

In an inkjet printing apparatus as described in Patent Literature 1, generally ultraviolet irradiator is configured by mounting a plurality of irradiation elements on a plurality of substrates. When the ultraviolet irradiator is configured by the plurality of substrates mounted with the plurality of irradiation elements, intervals between the irradiation elements become uneven due to clearances between the substrates, and there is a problem that illuminance of ultraviolet light irradiated from the ultraviolet irradiator becomes uneven. As a result, a problem that a quality of an image printed on a recording medium is deteriorated occurs.

Thus, the present disclosure has been made in view of the above problems, and an aim is to provide an inkjet printing apparatus that can print on a recording medium with a satisfactory image quality.

Solutions to the Problems

To solve the problems, an inkjet printing apparatus according to one embodiment of the present disclosure is configured to perform a printing operation on a recording medium in a plurality of passes. The inkjet printing apparatus includes: a head that reciprocates in a main scanning direction while discharging an ink curable by being irradiated with light on the recording medium from a plurality of nozzles; and an irradiator having a plurality of irradiation elements that are configured to irradiate the ink discharged from the head with light, and are mounted on one substrate. The plurality of irradiation elements are arranged in a sub scanning direction orthogonal to the main scanning direction, and an array pitch of the plurality of irradiation elements is n/m ($m \geq 1$), where a maximum pass width in the plurality of passes is n.

According to the above configuration, since the arrangement of the irradiation elements is determined according to the pass width, an irradiation quantity of ultraviolet light to be irradiated for each pass can be made substantially even. Further, by arranging the plurality of irradiation elements on one substrate, this contributes to making illuminance of the ultraviolet light to be irradiated from the irradiator substantially even. Due to this, a recording medium printed with a satisfactory image quality can be achieved.

Further, an inkjet printing apparatus according to one aspect of the present disclosure may further include an intensity controller configured to control an intensity of ultraviolet light irradiated from each of the plurality of irradiation elements in accordance with a direction towards which the head reciprocates.

According to the above configuration, the irradiation quantity of the ultraviolet light that ink droplets discharged from the respective nozzles of the head receive can be made even, and an unevenness in the illuminance over an entire recording medium is thereby reduced. Due to this, a deterioration of the quality of the image printed on the recording medium is suppressed, and as a result, printing can be performed on the recording medium with high image quality.

Further, in an inkjet printing apparatus according to one aspect of the present disclosure, the irradiator may have a plurality of rows of the plurality of irradiation elements arranged in the sub scanning direction on the substrate, and the plurality of rows may be arranged in the main scanning direction.

According to the above configuration, a difference between a minimum irradiation intensity and a maximum irradiation intensity in the irradiator can be made larger, so the irradiation intensity of the irradiator can be controlled in plural levels.

Further, in an inkjet printing apparatus according to one aspect of the present disclosure, the plurality of nozzles of the head may be divided into a plurality of pass rows corresponding to each of the passes, and the plurality of irradiation elements may be arranged so that the irradiation elements are positioned over borderlines between adjacent pairs of pass rows.

According to the above configuration, the intensity of the ultraviolet light irradiated onto the borders of the adjacent pass rows becomes larger. As a result, generations of bandings that may occur at the borders of the adjacent pass rows can be suppressed, and the quality of the image to be printed on the recording medium becomes satisfactory.

Further, in an inkjet printing apparatus according to one aspect of the present disclosure, the array pitch of the plurality of irradiation elements may be q/p ($p \geq 1$), where a minimum pass width in the plurality of passes is q.

Further, in an inkjet printing apparatus according to one aspect of the present disclosure, the array pitch of the plurality of irradiation elements may be equal to the minimum pass width.

According to the above configuration, since the plurality of irradiation elements are arranged at regular intervals for every minimum pass width, the irradiation quantity of the ultraviolet light irradiated in pass units can further be made even. Due to this, a recording medium printed with more satisfactory image quality can be achieved.

Effect of the Invention

According to an inkjet printing apparatus of one aspect of the present disclosure, since the arrangement of the irradiation elements is determined according to the pass width, the irradiation quantity of the ultraviolet light irradiated in pass units can be made substantially even. Further, by arranging the plurality of irradiation elements on one substrate, this contributes to making illuminance of the ultraviolet light to be irradiated from the irradiator substantially even. Due to this, a recording medium printed with a satisfactory image quality can be achieved.

DESCRIPTION OF EMBODIMENTS

First Embodiment

Figure 1:
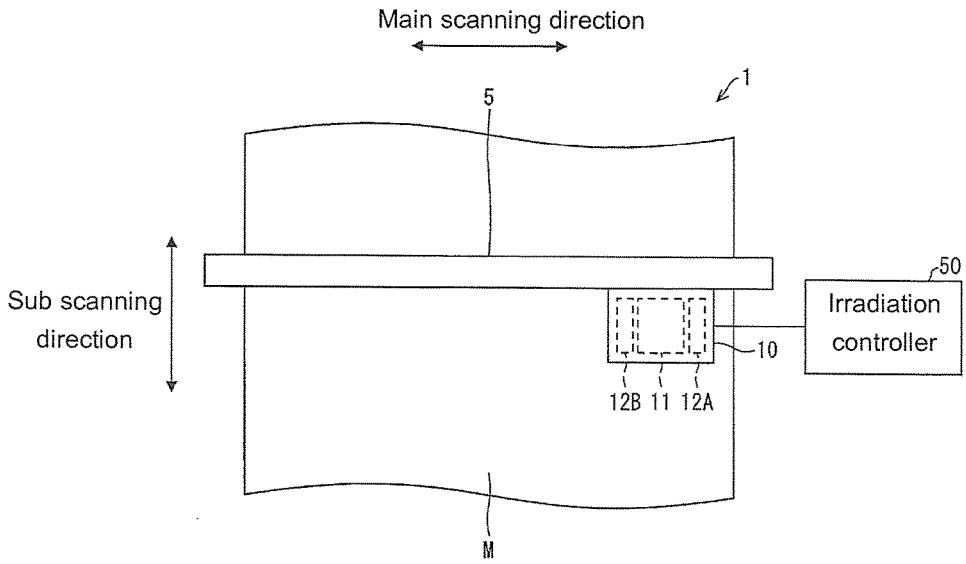
FIG. 1 is a schematic diagram of an inkjet printing apparatus according to one embodiment of the present disclosure.
Figure 2:
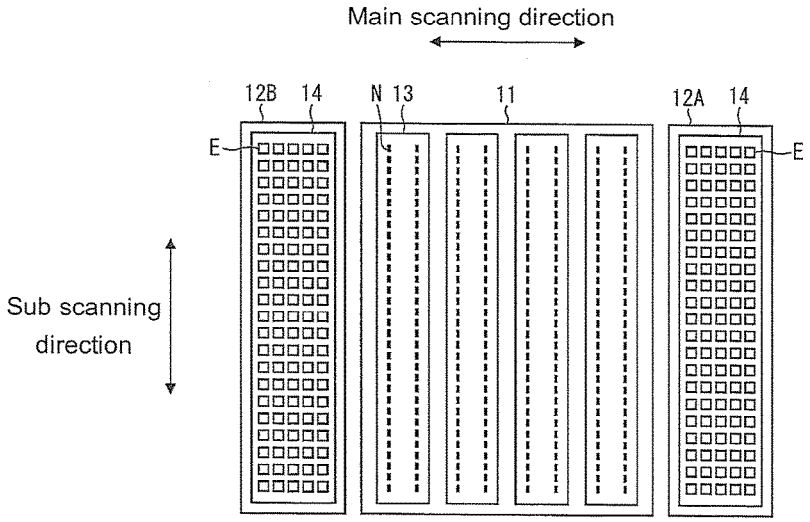
FIG. 2 is a diagram schematically showing a structure of a carriage provided in the inkjet printing apparatus according to one embodiment of the present disclosure.

An embodiment of an inkjet printing apparatus of the present disclosure will be described with reference to FIGS. 1 and 2. FIG. 1 is a schematic diagram of an inkjet printing apparatus 1. FIG. 2 is a diagram schematically showing a structure of a carriage 10 provided in the inkjet printing apparatus 1.

The inkjet printing apparatus 1 includes a Y bar 5, the carriage 10, and an irradiation controller 50. Further, the inkjet printing apparatus 1 performs a printing operation on a medium (recording medium) M, and in FIG. 1, the medium M is mounted on a medium-setting table (not shown).

[Y Bar 5]

The Y bar 5 extends in one direction. The direction in which the Y bar 5 extends is a main scanning direction of the inkjet printing apparatus 1. In other words, the main scanning direction refers to a direction parallel to a direction along the surface of the medium-setting table. The sub scanning direction refers to a direction orthogonal to the main scanning direction and parallel to a direction along the surface of the medium-setting table. The medium M is transported in the sub scanning direction.

[Carriage 10]

The carriage 10 is attached to the Y bar 5 and reciprocates in the main scanning direction. The carriage 10, by way of its reciprocating motion, moves relative to the medium-setting table, allowing the head 11, described later, to move relative to the medium-setting table. This embodiment describes an example in which the head 11 moves in the main scanning direction but the medium M does not move in the main scanning direction. However, the present disclosure is not limited hereto, but may include an inkjet printing apparatus having a fixed head and structured to reciprocate a recording medium in the main scanning direction.

The carriage 10 includes the head 11, a left irradiator (irradiator) 12A, and a right irradiator (irradiator) 12B.

[Head 11]

The head 11 discharges inks curable by being irradiated with light on the medium M. Specifically, the head 11 has a plurality of nozzle arrays 13. Each of the nozzle arrays 13 has a plurality of nozzles N formed therein, through which the inks are discharged. The inks may be any inks curable by being irradiated with light emitted from the irradiators, and for example, the light and the inks may be preferably ultraviolet light and inks of ultraviolet curing type, respectively. In this embodiment, the head 11 discharges inks of ultraviolet curing type.

[Left Irradiator 12A and Right Irradiator 12B]

The left irradiator 12A and the right irradiator 12B are for irradiating ultraviolet light onto the ink discharged from the head 11. The ink discharged from the head 11 cures by the ultraviolet light irradiated from the left irradiator 12A and the right irradiator 12B. Further, the left irradiator 12A and the right irradiator 12B are arranged in the main scanning direction and spaced at an interval that allows the head 11 to be interposed therebetween. Due to this, the left irradiator 12A and the right irradiator 12B move in the same direction as the moving direction of the head 11, that is, in the main scanning direction.

The left irradiator 12A is disposed at a position on the left side (left side on the drawing) of the head 11. The left irradiator 12A is configured by arranging a plurality of irradiation elements E such as LEDs that can emit the ultraviolet light at an intensity according to a supplied current value on one substrate 14 in the sub scanning direction. The irradiation elements E have the characteristic of having a higher irradiation intensity proportional to the supplied current value, for example. Similarly, the right irradiator 12B is disposed at a position on the right side (right side on the drawing) of the head 11. The right irradiator 12B is configured by arranging a plurality of irradiation elements E such as LEDs that can emit the ultraviolet light at an intensity according to a supplied current value on one substrate 14 in the sub scanning direction. The irradiation elements E have the characteristic of having a higher irradiation intensity proportional to the supplied current value, for example. According to this configuration, the ultraviolet light emitted from the irradiation elements E are irradiated beneath the left irradiator 12A and the right irradiator 12B.

[Irradiation Controller 50]

The irradiation controller 50 controls the light irradiation by the left irradiator 12A and the right irradiator 12B. For example, the irradiation controller 50 controls the intensity of the ultraviolet light irradiated from each of the irradiation elements E in accordance with directions that the head 11 reciprocates.

The irradiation controller 50 is configured to control the intensity of the ultraviolet light irradiated from the left irradiator 12A and the right irradiator 12B downward by controlling the supplied current values to each irradiation element E in the left irradiator 12A and the right irradiator 12B. The irradiation controller 50 has a configuration capable of controlling the intensity of the ultraviolet light independently for the left irradiator 12A and the right irradiator 12B.

Figure 3:
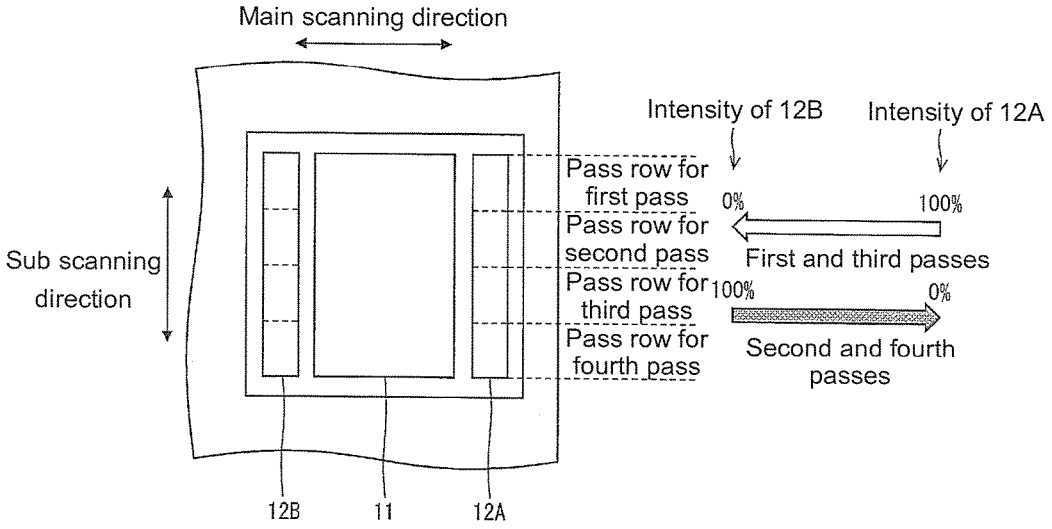
FIG. 3 is a diagram showing changes in intensity of ultraviolet light irradiated from a right irradiator and a left irradiator according to one embodiment of the present disclosure.

Hereinbelow, an ultraviolet light intensity control by the irradiation controller 50 will be described with reference to FIG. 3. FIG. 3 is a diagram that shows changes in the intensity of the ultraviolet light irradiated from the left irradiator 12A and the irradiator 12B in pass units. Notably, the ultraviolet light intensity control described hereinbelow exemplifies a case where printing is performed in 4 passes (case of performing printing by adhering the ink by overlapping it four times). Further, the explanation will be given of a case where the irradiation controller 50 controls the intensity of the ultraviolet light irradiated from the left irradiator 12A and the right irradiator 12B to be at a maximum intensity (about 100%) or at a minimum intensity (about 0%) according to the moving direction of the carriage 10.

Firstly, a printing method will be roughly described. The ink is discharged from the nozzles N formed on a lower surface of the head 11 while moving the carriage 10 in the main scanning direction in reciprocating motions along the Y bar 5 relative to the medium M mounted on the medium-setting table, and the ink is adhered onto the medium M in a desired pattern. At this occasion, the ultraviolet light is irradiated from the left irradiator 12A and the right irradiator 12B toward the medium M, so the ink adhered to the medium M is thereby cured and printing operation is performed according thereto.

Now, when 100% of the ink is discharged at once to form the desired pattern (performing printing in a single pass), a large amount of ink adheres onto the surface of the medium M in an uncured state, thus blurring tends to occur by the ink being mixed. Thus, the inkjet printing apparatus 1 is configured to perform printing by a plurality of passes (multi-pass scheme) in which the carriage 10 reciprocates in the main scanning direction while discharging the ink from the head 11 and the head 11 is caused to pass over the medium M for plural times so as to adhere 100% of the ink in the end. For example, the printing is performed by reciprocating the carriage 10 in the main scanning direction while discharging 25% of ink from the head 11, and causing the head 11 to pass over the medium M four times in total, so as to adhere 100% of the ink in the end. By doing so, the printing suppressing the generation of blurring can be performed. In this case, as shown in FIG. 3, the plurality of nozzles N in the head 11 are divided into a plurality of pass rows corresponding to the passes.

When the carriage 10 starts to move leftward (move toward the left side on the drawing), information indicating that the carriage 10 started to move leftward is sent to the irradiation controller 50. Based on the received information, the irradiation controller 50 performs control to irradiate the ultraviolet light with 0% intensity from the left irradiator 12A and the ultraviolet light with 100% intensity from the right irradiator 12B during when the ink for one pass is discharged from the pass row for the first pass of the head 11. Due to this, in the first pass, the ink for one pass discharged from the head 11 adheres to the medium M after the ultraviolet light with 0% intensity is irradiated onto the medium M from the left irradiator 12A, and after this the ultraviolet light with 100% intensity is irradiated from the right irradiator 12B onto the medium M.

In the first pass as above, after when the carriage 10 has moved to a left end of the medium M, the medium M is fed forward (in the sub scanning direction) by one pass width. Then, when the carriage 10 starts to move rightward (move toward the right side on the drawing), information indicating that the carriage 10 started to move rightward is sent to the irradiation controller 50. Based on the received information, the irradiation controller 50 performs control to irradiate the ultraviolet light with 100% intensity from the left irradiator 12A and the ultraviolet light with 0% intensity from the right irradiator 12B during when the ink for one pass is discharged from the pass row for the second pass of the head 11. Due to this, in the second pass, the ink for one pass discharged from the head 11 adheres to the medium M after the ultraviolet light with 0% intensity is irradiated from the right irradiator 12B onto the medium M, and after this the ultraviolet light with 100% intensity is irradiated from the left irradiator 12A onto the medium M.

In the second pass as above, after when the carriage 10 has moved to a right end of the medium M, the medium M is fed forward by one pass width similar to after the first pass. Further, similar to the first pass, when the carriage 10 starts to move leftward, information indicating that the carriage 10 started to move leftward is sent to the irradiation controller 50. Based on the received information, the irradiation controller 50 performs control to irradiate the ultraviolet light with 0% intensity from the left irradiator 12A and the ultraviolet light with 100% intensity from the right irradiator 12B during when the ink for one pass is discharged from the pass row for the third pass of the head 11. In the third pass as above, after when the carriage 10 has moved to the left end of the medium M, the medium M is fed forward by one pass width similar to after the second pass. Further, similar to the second pass, when the carriage 10 starts to move rightward, information indicating that the carriage 10 started to move rightward is sent to the irradiation controller 50. Based on the received information, the irradiation controller 50 performs control to irradiate the ultraviolet light with 100% intensity from the left irradiator 12A and the ultraviolet light with 0% intensity from the right irradiator 12B during when the ink for one pass is discharged from the pass row for the fourth pass of the head 11. The printing on the medium M is completed by this fourth pass being executed.

Generally, in the inkjet printing apparatus 1, irradiation quantities of the ultraviolet light received from the left irradiator 12A or the right irradiator 12B are different from the nozzles N in the leftmost row of the head 11 and the nozzles N in the rightmost row of the head 11. Due to this, since the irradiation quantities of the ultraviolet light received by the ink droplets discharged from the respective nozzles N are different, an unevenness in the illuminance may occur over an entire medium M, resulting in a problem that a quality of an image to be printed on the medium M is deteriorated. Thus, in the inkjet printing apparatus 1, the intensities of the ultraviolet light irradiated from the left irradiator 12A and the right irradiator 12B are controlled independently according to the moving direction (leftward or rightward) of the carriage 10, so as to make the irradiation quantities of the ultraviolet light received by the ink droplets discharged from the respective nozzles N even, and reduce the unevenness in the illuminance over the entire medium M. Due to this, a deterioration of the quality of the image printed on the medium M is suppressed, and as a result, printing can be performed on the medium M with high image quality.

Notably, the irradiation controller 50 is not limited to the case of controlling the intensities of the ultraviolet light irradiated from the left irradiator 12A and the right irradiator 12B according to the moving direction of the carriage 10. For example, the irradiation controller 50 may control the intensities of the ultraviolet light irradiated respectively from the plurality of irradiation elements E according to the position of the carriage 10 in the main scanning direction. That is, the irradiation controller 50 may increase the intensity of the ultraviolet light irradiated respectively from the plurality of irradiation elements E in multilevel or may reduce the intensity in multilevel according to the carriage 10 moving leftward or rightward.

[Pitch of Irradiation Elements E]

Figure 4:
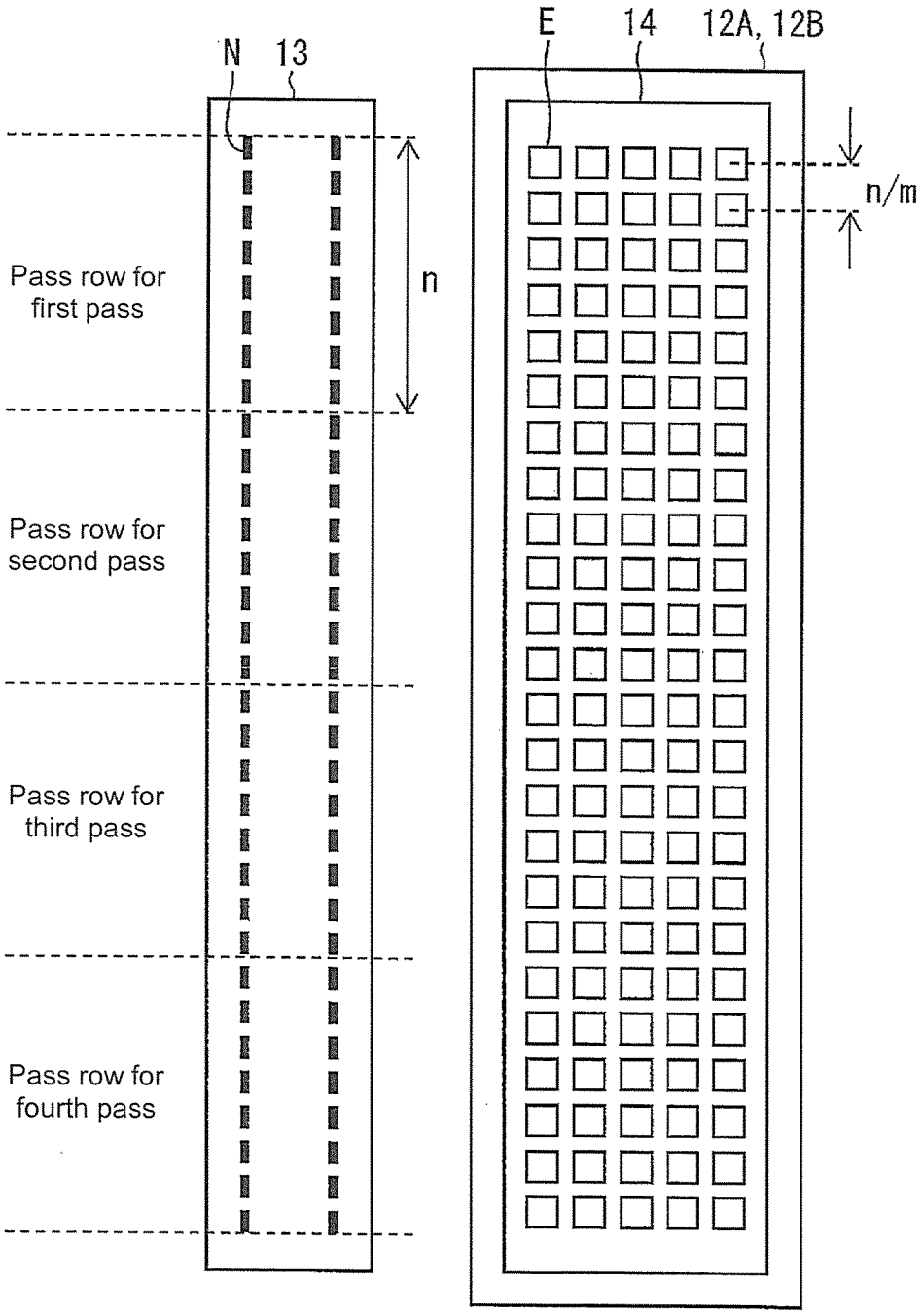
FIG. 4 is a diagram showing a relationship between a maximum pass width and an array pitch of irradiation elements in the inkjet printing apparatus according to one embodiment of the present disclosure.

Other than the unevenness in the illuminance caused by the irradiation quantities of the ultraviolet light received respectively by the ink droplets discharged from the nozzles N, there also is an unevenness in the illuminance caused by the irradiation quantities of the ultraviolet light irradiated among passes being different. In the inkjet printing apparatus 1 according to the present embodiment, to address the above problem, the arrangement of the irradiation elements E is determined according to a pass width of the inkjet printing apparatus 1. This will be described with reference to FIG. 4. FIG. 4 is a diagram showing a relationship between a maximum pass width and an array pitch of the irradiation elements E in the inkjet printing apparatus 1.

As described above, in the inkjet printing apparatus 1, the left irradiator 12A and the right irradiator 12B are configured respectively by arranging the plurality of irradiation elements E on one substrate 14 in the sub scanning direction. At this occasion, as shown in FIG. 4, an array pitch of the plurality of irradiation elements E is n/m (m≥1), where a maximum pass width in the inkjet printing apparatus 1 is n. The array pitch of the plurality of irradiation elements E means a distance between centers of two adjacent irradiation elements E. Further, the maximum pass width means a pass width corresponding to one pass in the printing using a minimum pass number performed by the inkjet printing apparatus 1. In other words, it is a width of one pass row in the printing using the minimum pass number performed by the inkjet printing apparatus 1. For example in FIG. 4, the minimum pass number performed by the inkjet printing apparatus 1 is 4 passes, and the maximum pass width is a width of these pass rows.

By setting the array pitch of the irradiation elements E to a value that divides the maximum pass width by a number of 1 or greater (that is, n/m), the plurality of irradiation elements E are arranged at regular intervals for every maximum pass width. Accordingly, in this embodiment, the arrangement of the irradiation elements E is determined according to the pass width, thus the irradiation quantities of the ultraviolet light irradiated in pass units can be made substantially even. Due to this, a medium M printed with a satisfactory image quality can be achieved.

Especially, each of the left irradiator 12A and the right irradiator 12B is configured by arranging the plurality of irradiation elements E on one substrate 14. This configuration allows to omit clearances between substrates as compared to a case of arranging the left irradiator 12A and the right irradiator 12B having their plurality of irradiation elements E arranged on a plurality of substrates, and the intervals of the plurality of irradiation elements E can be prevented from becoming uneven due to the clearances. That is, by arranging the plurality of irradiation elements E on one substrate 14, this contributes to making the illuminance of the ultraviolet light irradiated from the left irradiator 12A and the right irradiator 12B substantially even. Notably, there also is the advantage that the control of the irradiation intensities of the respective irradiation elements E by the irradiation controller 50 becomes easier when the left irradiator 12A and the right irradiator 12B have their plurality of irradiation elements E arranged on one substrate 14.

Here, each of the left irradiator 12A and the right irradiator 12B preferably has plural rows of plurality of irradiation elements E arranged in the sub scanning direction on the substrate 14, and the plurality of rows are arranged in the main scanning direction. Due to this, the irradiation quantities of the ultraviolet light irradiated respectively from the left irradiator 12A and the right irradiator 12B can be made larger. In addition, according to the above configuration, the control of the left irradiator 12A and the right irradiator 12B can be performed more finely. That is, the differences between the minimum irradiation intensities and the maximum irradiation intensities of the left irradiator 12A and the right irradiator 12B, respectively can made larger, and the irradiation intensities of the left irradiator 12A and the right irradiator 12B can be controlled in multilevel.

Further, in addition to the condition mentioned above, the array pitch of the plurality of irradiation elements E preferably is q/p (p≥1), where a minimum pass width in the plurality of passes is q, and more preferably is q. The minimum pass width means a pass width corresponding to one pass in the printing using a maximum pass number performed by the inkjet printing apparatus 1. In other words, it is a width of one pass row in the printing using the maximum pass number performed by the inkjet printing apparatus 1. Due to this, the plurality of irradiation elements E are arranged at regular intervals for every minimum pass width. Due to this, the irradiation quantity of the ultraviolet light irradiated for every pass can further be made even. Due to this, a medium M printed with a more satisfactory image quality can be achieved.

Second Embodiment

Figure 5:
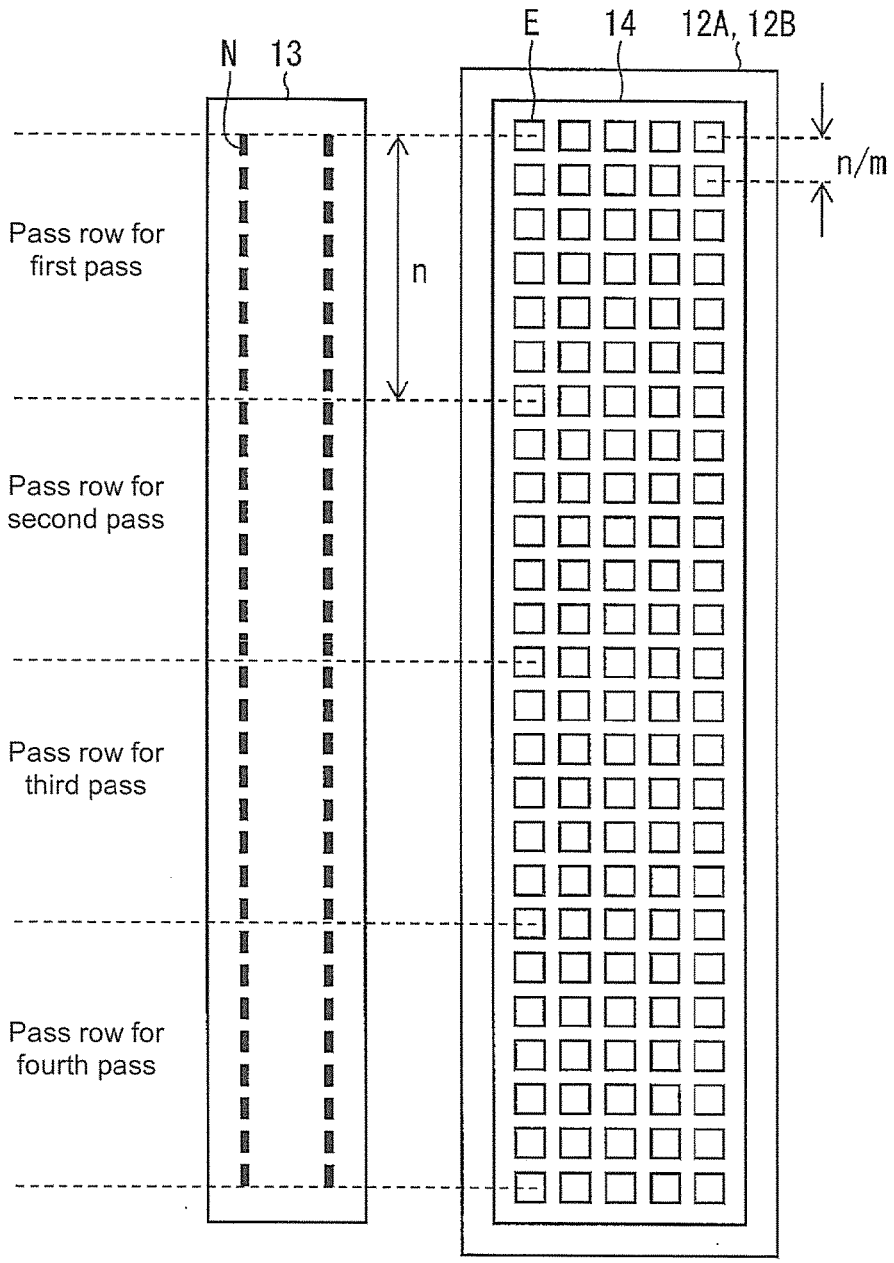
FIG. 5 is a diagram showing a relationship between a maximum pass width and an array pitch of irradiation elements in an inkjet printing apparatus according to another embodiment of the present disclosure.

Another embodiment of an inkjet printing apparatus of the present disclosure be described with reference to FIG. 5. FIG. 5 is a diagram showing the relationship between the maximum pass width and the array pitch of the irradiation elements E in the inkjet printing apparatus 1. Hereinbelow, points differing from the first embodiment will be described.

In the inkjet printing apparatus 1, generally, a plurality of bands, for which printing has been completed by the printing for all of the passes having been performed, is formed in the sub scanning direction on the medium M. On the medium M, there generally may be cases where banding occurs in a border between adjacent bands due to ink blurring at the border between the adjacent bands or by darkness of the ink droplets discharged from the nozzles N at the border, and the like. Such a banding deteriorates the quality of the image printed on the medium M.

The present inventors conducted various studies on the banding generated at the border between the adjacent bands, and keenly sought for a method to suppress the banding, and found that the banding can be suppressed better with higher intensity of ultraviolet light being irradiated on the border between the adjacent bands. Thus, in this embodiment, the plurality of irradiation elements E are arranged in the head 11 so that the irradiation elements E are positioned above borderlines between pairs of adjacent pass rows. For example, in FIG. 5, the irradiation elements E are arranged above the borderline between the pass row for the first pass and the pass row for the second pass, and the irradiation elements E are arranged above the borderline between the pass row for the second pass and the pass row for the third pass. The same applies to the pass row for the third pass and the pass row for the fourth pass.

In the head 11, by having the plurality of irradiation elements E arranged so that the irradiation elements E are positioned above the borderlines of the pairs of adjacent pass rows, the intensity of the ultraviolet light irradiated onto the borders of the bands becomes large. As a result, the generation of the banding at the borders between the adjacent bands is suppressed, and the quality of the image printed on the medium M becomes satisfactory.

Notably, in the present embodiment as well, the array pitch of the plurality of irradiation elements E is n/m (m is an integer), where the maximum pass width of the plurality of passes in the inkjet printing apparatus 1 is n. Due to this, the irradiation quantities of the ultraviolet light irradiated for every pass can be made substantially even, and the medium M printed with a more satisfactory image quality can be achieved. However, the printing can be performed with sufficiently satisfactory image quality on the medium M even with the configuration in which the plurality of irradiation elements E are arranged in the head 11 so that the irradiation elements E are located above the borderlines of pairs of adjacent pass rows.

The present disclosure is not limited to the embodiments as mentioned above, and various alterations and modifications can be made within the scope described in the claims, and embodiments obtained by suitably combining the technical features disclosed in different embodiments are also encompassed by the technical scope of the present disclosure.

Additional Remarks

An inkjet printing apparatus 1 according to one embodiment of the present disclosure performs printing operation in a plurality of passes on a recording medium (medium M). The inkjet printing apparatus 1 includes: a head 11 that reciprocates in a main scanning direction while discharging an ink curable by being irradiated with light from a plurality of nozzles N onto the recording medium; and an irradiator (left irradiator 12A and right irradiator 12B) having a plurality of irradiation elements E that are configured to irradiate the ink discharged from the head 11 with light, and are mounted on one substrate 14, where the plurality of irradiation elements E are arranged in a sub scanning direction orthogonal to the main scanning direction, and an array pitch of the plurality of irradiation elements E is n/m (m≥1), where a maximum pass width is n.

According to the above configuration, since the arrangement of the irradiation elements E is determined according to the pass width, an irradiation quantity of ultraviolet light to be irradiated for each pass can be made substantially even. Further, by arranging the plurality of irradiation elements E on one substrate 14, this contributes to making illuminance of the ultraviolet light to be irradiated from the irradiator substantially even. Due to this, a recording medium printed with a satisfactory image quality can be achieved.

Further, an inkjet printing apparatus 1 according to one embodiment of the present disclosure may further include an intensity controller (irradiation controller 50) configured to control an intensity of ultraviolet light irradiated from each of the plurality of irradiation elements E in accordance with a direction towards which the head 11 reciprocates.

According to the above configuration, the irradiation quantity of the ultraviolet light that ink droplets discharged from the respective nozzles N of the head 11 receive can be made even, and an unevenness in the illuminance over an entire recording medium is thereby reduced. Due to this, a deterioration of the quality of the image printed on the recording medium is suppressed, and as a result, printing can be performed on the recording medium with high image quality.

Further, in an inkjet printing apparatus 1 according to one embodiment of the present disclosure, the irradiator may have a plurality of rows of the plurality of irradiation elements E arranged in the sub scanning direction on the substrate 14, and the plurality of rows may be arranged in the main scanning direction.

According to the above configuration, a difference between a minimum irradiation intensity and a maximum irradiation intensity in the irradiator can be made larger, so the irradiation intensity of the irradiator can be controlled in plural levels.

Further, in an inkjet printing apparatus 1 according to one embodiment of the present disclosure, the plurality of nozzles N of the head 11 may be divided into a plurality of pass rows corresponding to each of the passes, and the plurality of irradiation elements E may be arranged so that the irradiation elements E are positioned over borderlines between adjacent pairs of pass rows.

According to the above configuration, the intensity of the ultraviolet light irradiated onto the borders of the adjacent bands becomes larger. As a result, generations of bandings that may occur at the borders of the adjacent bands can be suppressed, and the quality of the image to be printed on the recording medium becomes satisfactory.

Further, in an inkjet printing apparatus 1 according to one embodiment of the present disclosure, the array pitch of the plurality of irradiation elements E may be q/p (p≥1), where a minimum pass width in the plurality of passes is q.

Further, in an inkjet printing apparatus 1 according to one embodiment of the present disclosure, the array pitch of the plurality of irradiation elements E may be equal to the minimum pass width.

According to the above configuration, since the plurality of irradiation elements E are arranged at regular intervals for every minimum pass width, the irradiation quantity of the ultraviolet light irradiated in pass units can further be made even. Due to this, a recording medium printed with more satisfactory image quality can be achieved.

INDUSTRIAL APPLICABILITY

The present disclosure is applicable to an inkjet printing apparatus.

The invention claimed is:

1. An inkjet printing apparatus configured to perform a printing operation in a plurality of passes on a recording medium, the inkjet printing apparatus comprising:

a head that reciprocates in a main scanning direction while discharging an ink curable by being irradiated with light, from a plurality of nozzles onto the recording medium; and an irradiator having a plurality of irradiation elements that are configured to irradiate the ink discharged from the head with light, and are mounted on one substrate, wherein the plurality of irradiation elements are LEDs and arranged in a sub scanning direction orthogonal to the main scanning direction, and an array pitch of the plurality of irradiation elements is n/m (m≥1), where n is a pass width of one of the plurality of passes in the printing operation using a minimum pass number performed by the inkjet printing apparatus, wherein the irradiation elements are equally arranged in each of the plurality of passes, and wherein the inkjet printing apparatus does not include a partition wall positioned between the irradiation elements.

2. The inkjet printing apparatus as set forth in claim 1, further comprising:

an intensity controller configured to control an intensity of ultraviolet light irradiated from each of the plurality of irradiation elements in accordance with a direction towards which the head reciprocates.

3. The inkjet printing apparatus as set forth in claim 1, wherein the irradiator has a plurality of rows of the plurality of irradiation elements arranged in the sub scanning direction on the substrate, the plurality of rows being arranged in the main scanning direction.

4. The inkjet printing apparatus as set forth in claim 1, wherein the plurality of nozzles of the head are divided into a plurality of pass rows corresponding to each of the passes, and the plurality of irradiation elements are arranged so that the irradiation elements are positioned over borderlines between adjacent pairs of pass rows.

5. The inkjet printing apparatus as set forth in claim 1, wherein the plurality of nozzles are arranged substantially equally with respect to each of the irradiation elements.

6. An inkjet printing apparatus configured to perform a printing operation in a plurality of passes on a recording medium, the inkjet printing apparatus comprising:

a head that reciprocates in a main scanning direction while discharging an ink curable by being irradiated with light, from a plurality of nozzles onto the recording medium; and an irradiator having a plurality of irradiation elements that are configured to irradiate the ink discharged from the head with light, and are mounted on one substrate, wherein the plurality of irradiation elements are LEDs and arranged in a sub scanning direction orthogonal to the main scanning direction, and an array pitch of the plurality of irradiation elements is q/p (p≥1), where q is a pass width of one of the plurality of passes in the printing operation using a maximum pass number performed by the inkjet printing apparatus, wherein the irradiation elements are equally arranged in each of the plurality of passes, and wherein the inkjet printing apparatus does not include a partition wall positioned between the irradiation elements.

7. The inkjet printing apparatus as set forth in claim 6, wherein the plurality of nozzles are arranged substantially equally with respect to each of the irradiation elements.

* * * * *